US008056535B2

(12) United States Patent
Matsuda et al.

(10) Patent No.: US 8,056,535 B2
(45) Date of Patent: Nov. 15, 2011

(54) INTAKE CONTROL SYSTEM FOR GENERAL-PURPOSE ENGINE

(75) Inventors: Hayato Matsuda, Wako (JP); Yoshinori Maekawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 302 days.

(21) Appl. No.: 12/473,450

(22) Filed: May 28, 2009

(65) Prior Publication Data

US 2009/0293845 A1 Dec. 3, 2009

(30) Foreign Application Priority Data

May 29, 2008 (JP) ..... 2008-141648

(51) Int. Cl.
*F02D 9/08* (2006.01)
*F02D 9/10* (2006.01)

(52) U.S. Cl. ..... 123/337

(58) Field of Classification Search ..... 123/337, 123/403, 399, 470, 472
See application file for complete search history.

(56) References Cited

U.S. PATENT DOCUMENTS 5,094,212 A * 3/1992 Kawaguchi et al. ..... 123/470
5,868,114 A * 2/1999 Kamimura et al. ..... 123/399
6,866,027 B1 * 3/2005 Marchesini et al. ..... 123/480

FOREIGN PATENT DOCUMENTS

JP 2005-98178 A 4/2005

* cited by examiner

*Primary Examiner* — Mahmoud Gimie
(74) *Attorney, Agent, or Firm* — Westerman, Hattori, Daniels & Adrian, LLP

(57) ABSTRACT

In an intake control system for a general-purpose engine, comprising: a motor which is attached to a first side wall, supporting one end portion of a valve shaft of a throttle valve, of a throttle body, and which drives the throttle valve to be opened and closed; a sensor unit which is attached to a second side wall supporting the other end portion of the valve shaft, and which detects an opening degree of the throttle valve; a fuel injection valve which is attached to a third side wall integrally connecting upper end portions of the first and second side walls to each other, and through which a fuel is injected into the intake path at a position downstream of the throttle valve; and an electronic control unit which is attached to a fourth side wall facing the third side wall, the electronic control unit is connected to the motor, the fuel injection valve and the sensor unit with first, second and third conducting wires, respectively. Accordingly, it is possible to allow significant shortening of wires, which electrically connect intake control elements to each other, by completing the wiring only around the throttle body.

2 Claims, 10 Drawing Sheets

INTAKE CONTROL SYSTEM FOR GENERAL-PURPOSE ENGINE

CROSS-REFERENCE TO RELATED APPLICATIONS

The present invention claims priority under 35 USC §119 based on Japanese patent application No. 2008-141648 filed May 29, 2008. The subject matter of this priority document is incorporated by reference herein.

BACKGROUND OF THE INVENTION

1. Field of the Invention

The present invention relates to an intake control system for a general-purpose engine, which includes an intake path, and in which a fuel injection valve through which a fuel is injected into the intake path at a position downstream of a throttle valve is attached to a throttle body supporting the throttle valve for opening and closing the intake path.

2. Description of the Related Art

There is known an intake system for a vehicle engine, as described in Japanese Patent Application Laid-open No. 2005-98178, which includes: a motor and a throttle sensor which are attached to a first side wall of a throttle body, the motor being for driving a throttle valve to open and close the throttle valve, the throttle sensor being for detecting the opening degree of the throttle valve, the first side wall supporting one end portion of a valve shaft of the throttle valve; an accelerator sensor attached to a second side wall of the throttle body, the accelerator sensor being for detecting an operation amount of an accelerator operating member, the second side wall supporting the other end portion of the valve shaft; and a fuel injection valve attached to a third side wall of the throttle body, the fuel injection valve being for injecting a fuel into an intake path at a position downstream of the throttle valve, the third side wall connecting the upper end portions of the first and second side walls to each other. In this case, an electronic control unit which operates the motor on the basis of detection signals from the accelerator sensor and the throttle sensor so as to control the opening degree of the throttle valve is generally provided to a vehicle body or the engine. Accordingly, the distance between the electronic control unit and each of the motor and the sensors is large, and long wires are thus needed to electrically connect therebetween.

When such a conventional system is employed in an intake control system for a general-purpose engine used under harsh conditions, a problem may arise on the wire.

SUMMARY OF THE INVENTION

The present invention has been made under such a circumstance. An object of the present invention is to provide an intake control system for a general-purpose engine, the intake control system being made compact and allowing significant shortening of wires, which electrically connect intake control elements to each other, by completing the wiring only around a throttle body.

In order to achieve the object, according to a feature of the present invention, there is provided an intake control system for a general-purpose engine, comprising: a throttle body which includes an intake path, and which supports opposite end portions of a valve shaft of a throttle valve for opening and closing the intake path; a motor which is attached to a first side wall of the throttle body, and which drives the throttle valve to be opened and closed, the first side wall supporting one end portion of the valve shaft; a sensor unit which is attached to a second side wall of the throttle body, and which detects an opening degree of the throttle valve, the second side wall supporting the other end portion of the valve shaft; a fuel injection valve which is attached to a third side wall of the throttle body, and through which a fuel is injected into the intake path at a position downstream of the throttle valve, the third side wall integrally connecting one end portions of the first and second side walls to each other; and an electronic control unit which is attached to a fourth side wall of the throttle body, and which controls operations of the motor and the fuel injection valve in accordance with an inputted preset number of revolutions of the engine and a detection signal from the sensor unit, the fourth side wall integrally connecting the other end portions of the first and second side walls to each other, wherein the electronic control unit is connected to the motor, the fuel injection valve and the sensor unit with first, second and third conducting wire, respectively.

According to the first feature of the present invention, it is possible to automatically control the number of revolutions of the engine to a preset number of revolutions inputted in the electronic control unit, while the engine is in operation. Moreover, by effectively using all of the first to fourth side walls of the throttle body surrounding the intake path, the four elements, namely, the motor, the sensor unit, the fuel injection valve and the electronic control unit, which are essential in intake control for a fuel injection general-purpose engine, are attached. Thus, the intake control system can be made compact. Furthermore, since the four elements are directly attached to the throttle body, the first to third conducting wires that electrically connect the electronic control unit to the motor, the sensor unit and the fuel injection valve, respectively, are significantly shortened. Thereby, even when the general-purpose engine is in operation under harsh conditions, a trouble on the wire can be prevented.

According to a second feature of the present invention, in addition to the first feature, the sensor unit detects an intake-air temperature and a boost pressure in the intake path besides the opening degree of the throttle valve, and inputs these detection signals into the electronic control unit.

According to the second feature of the present invention, the opening degree of the throttle valve and the fuel injection amount from the fuel injection valve are corrected quickly in accordance with the changes in the intake-air temperature and engine load, thus allowing the variation in the number of revolutions of the engine to be reduced.

The above description, other objects, characteristics and advantages of the present invention will be clear from detailed descriptions which will be provided for the preferred embodiment referring to the attached drawings.

DESCRIPTION OF THE PREFERRED EMBODIMENT

An embodiment of the present invention will be explained below based on FIGS. 1 to 10.

Figure 1:
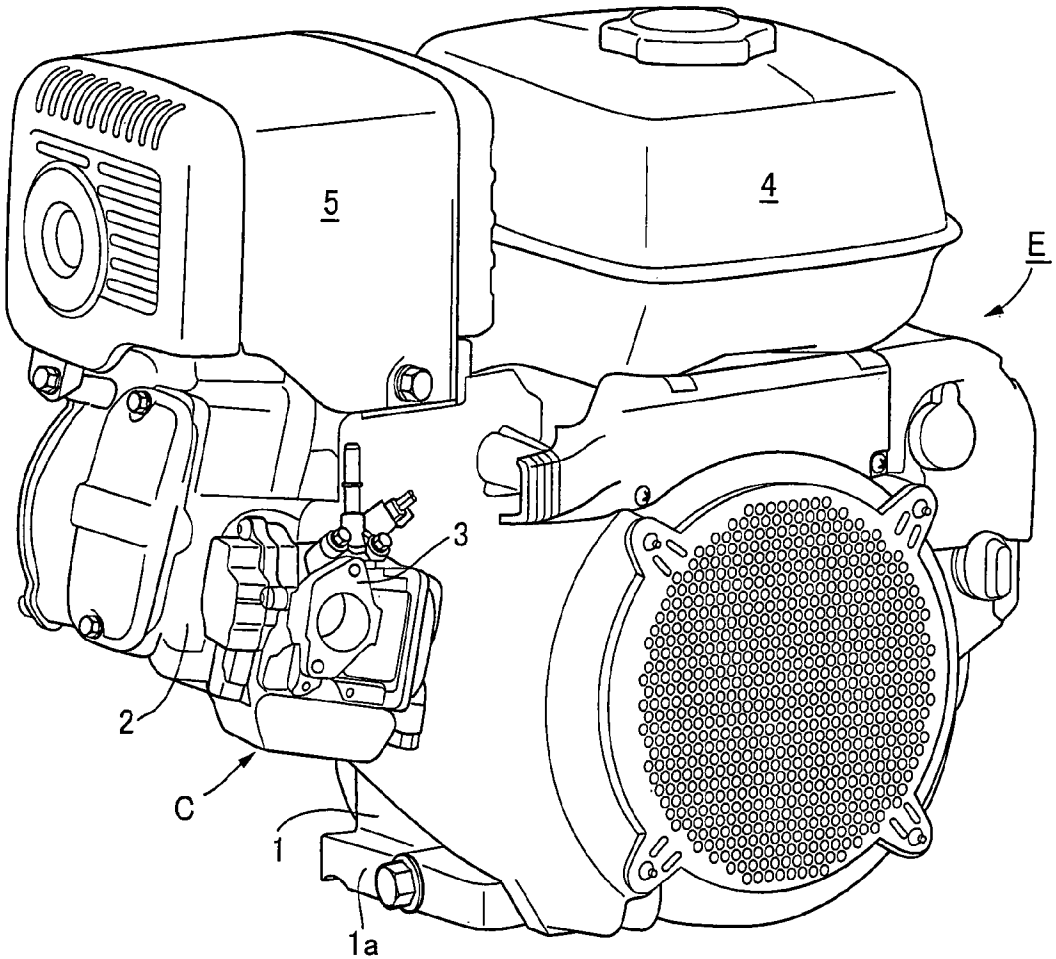
FIG. 1 is a perspective view of a general-purpose engine equipped with an intake control system of the present invention.
Figure 2:
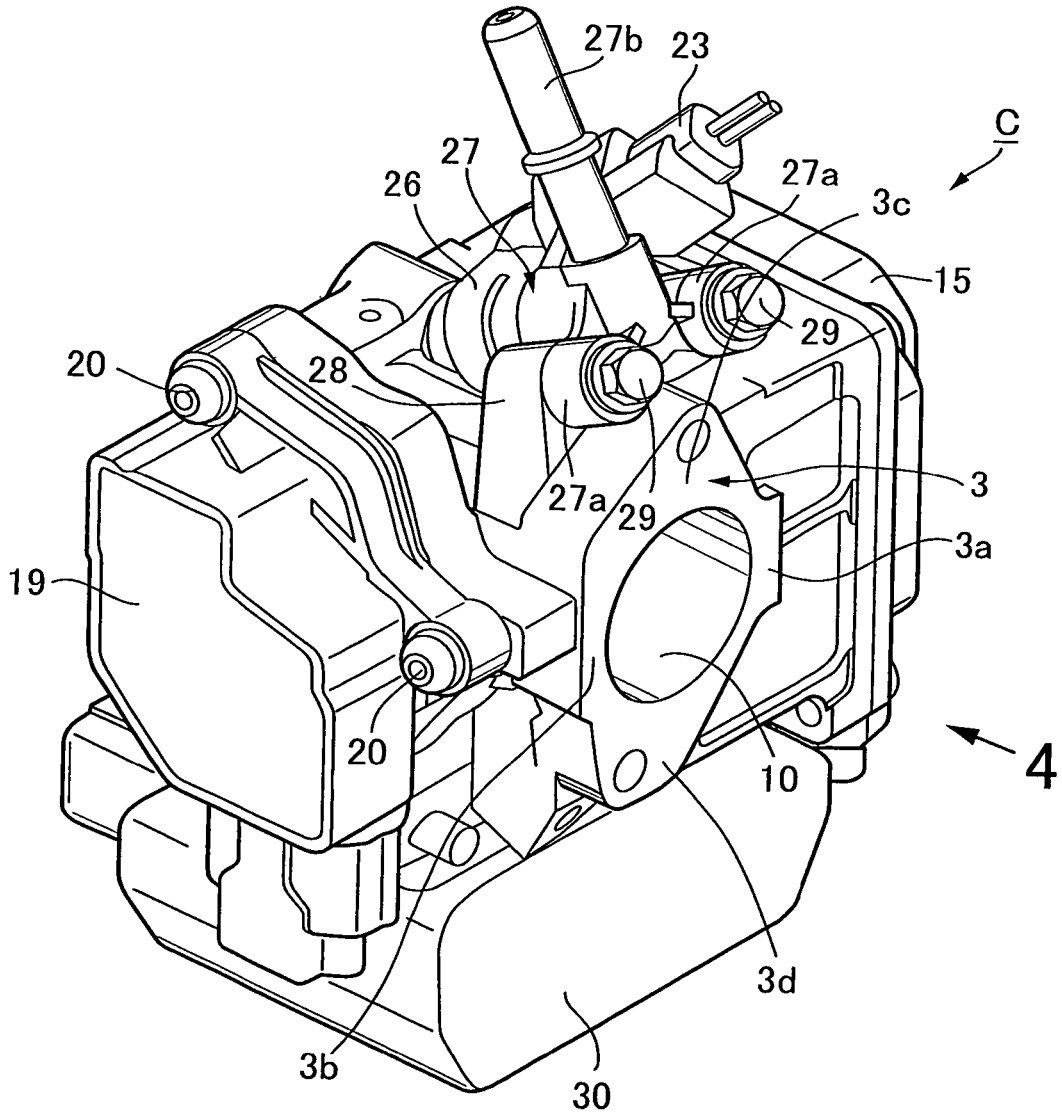
FIG. 2 is a perspective view, seen from a downstream side of an intake path, of the above-described intake control system.
Figure 3:
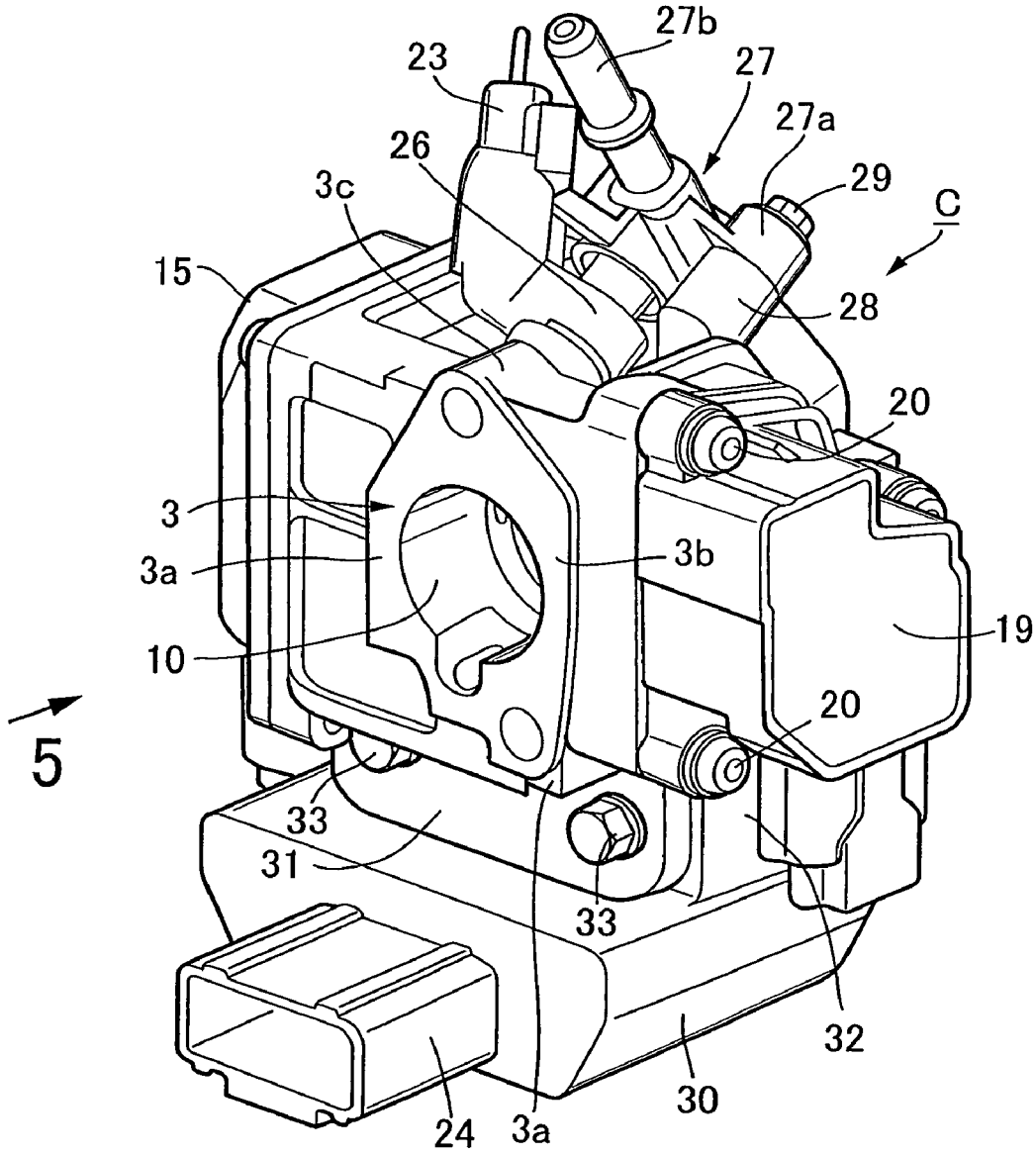
FIG. 3 is a perspective view, seen from an upstream side of the intake path, of the same intake control system.
Figure 4:
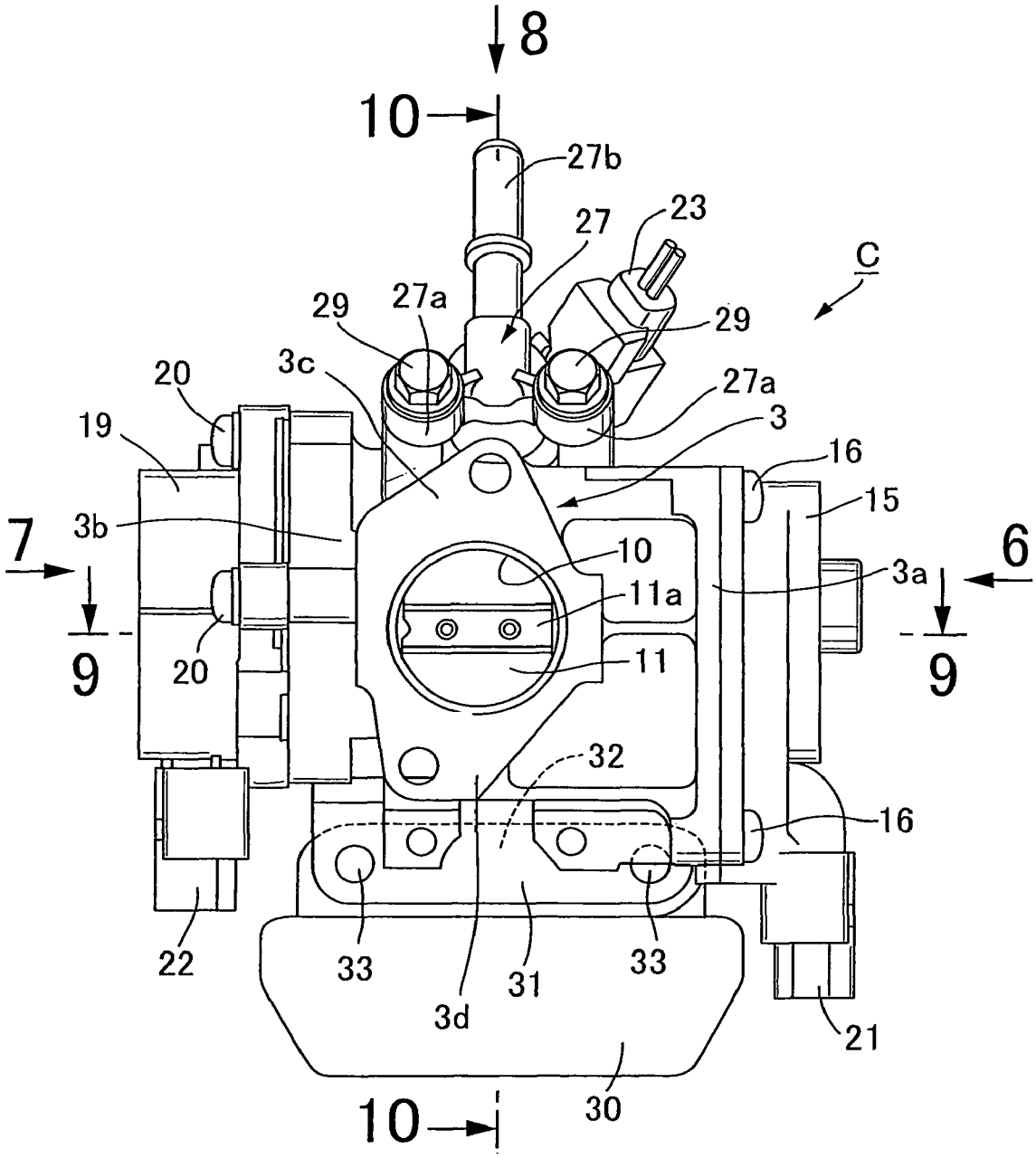
FIG. 4 is a view seen from an arrow 4 in FIG. 2.

At first, in FIG. 1, a general-purpose engine E includes: a crankcase 1 having a lower surface provided with a mounting flange 1*a*; and a cylinder block 2 protruding substantially horizontally (to be more specific, slightly upward) from one side portion of the crankcase 1. A throttle body 3 is attached to one side surface, in a horizontal direction, of a head portion of the cylinder block 2. A fuel tank 4 is provided immediately above the crankcase 1, and an exhaust muffler 5 is provided immediately above the cylinder block 2.

Now, an intake control system C including the above-described throttle body 3 will be explained below based on FIGS. 2 to 10.

In FIGS. 2 to 5 and 9, the throttle body 3 includes a horizontal intake path 10 which communicates with an intake port of the head portion of the cylinder block 2. The intake path 10 is opened and closed by a throttle valve 11. The throttle valve 11 is of butterfly type, and a valve shaft 11*a* thereof is disposed horizontally. Both end portions of the valve shaft 11*a* are rotatably supported respectively by first and second side walls 3*a*, 3*b* of the throttle body 3. The first and second side walls 3*a*, 3*b* face each other with the intake path 10 therebetween.

A reduction chamber 12 is formed in the first side wall 3*a* of the throttle body 3, which supports one end portion of the valve shaft 11*a*. A motor 14 and a motor housing 15 are attached to the first side wall 3*a* with bolts 16. The motor 14 drives the valve shaft 11*a* with a reduction gear 13 accommodated in the reduction chamber 12. The motor housing 15 accommodates the motor 14.

Meanwhile, a sensor unit 19 is attached to the second side wall 3*b* of the throttle body 3, which supports the other end portion of the valve shaft 11*a*. The sensor unit 19 includes: a throttle sensor 17 that detects the opening degree of the throttle valve 11; an intake-air temperature sensor 18 that detects the temperature within the intake path 10 at a position upstream of the throttle valve 11; a boost pressure sensor 34 that detects the pressure within the intake path 10 at a position downstream of the throttle valve 11; and the like.

First and second couplers 21, 22 for electrical connection are formed at lower end portions of the motor housing 15 and the sensor unit 19, respectively. The first and second couplers 21, 22 protrude toward a side of an electronic control unit 30, which will be described below.

As shown in FIGS. 2, 4, 8 and 10, a fuel injection hole 25 is formed in a third side wall 3*c* of the throttle body 3, which integrally connects upper end portions of the first and second side walls 3*a*, 3*b* to each other. The fuel injection hole 25 is opened obliquely toward the intake path 10 at a position downstream of the throttle valve 11, and an electro-magnetic fuel injection valve 26 is installed therein with its fuel injection port being directed toward the downstream side of the intake path 10. An injection valve holder 27 is fitted onto an end portion, on the fuel inlet side, of the fuel injection valve 26. The injection valve holder 27 includes, as one unit, a pair of bosses 27*a* and a fuel joint 27*b* that communicates with the fuel inlet of the fuel injection valve 26. The pair of bosses 27*a* are respectively fixed to a pair of ear-shaped pieces 28 formed on the third side wall 3*c* with bolts 29. In this way, the fuel injection valve 26 is attached to the third side wall 3*c*. A third coupler 23 for electrical connection is formed at one side of the fuel injection valve 26. The fuel joint 27*b* is connected to a fuel conduit that guides fuel ejected from an unillustrated fuel pump.

Figure 5:
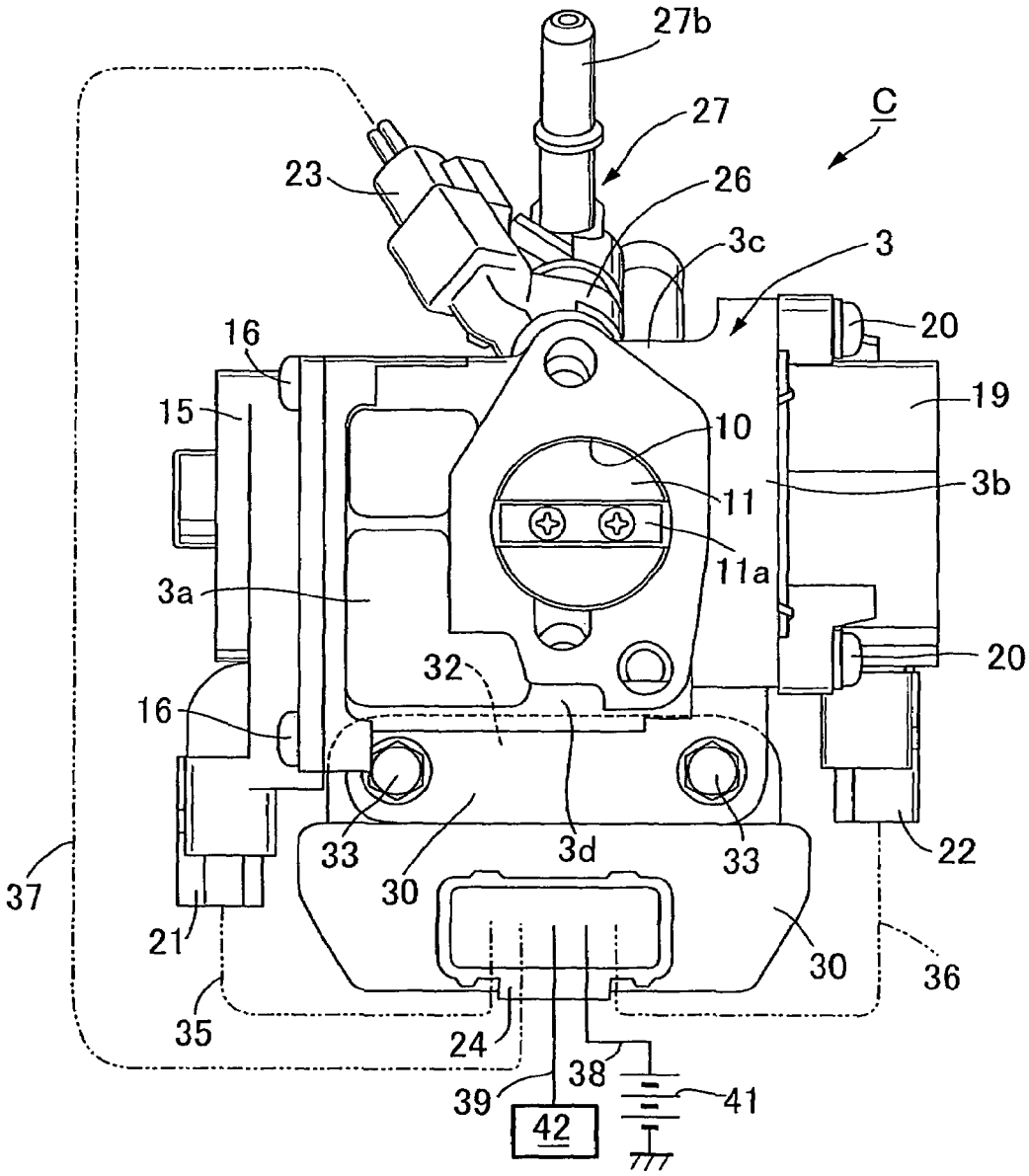
FIG. 5 is a view seen from an arrow 5 in FIG. 3.
Figure 6:
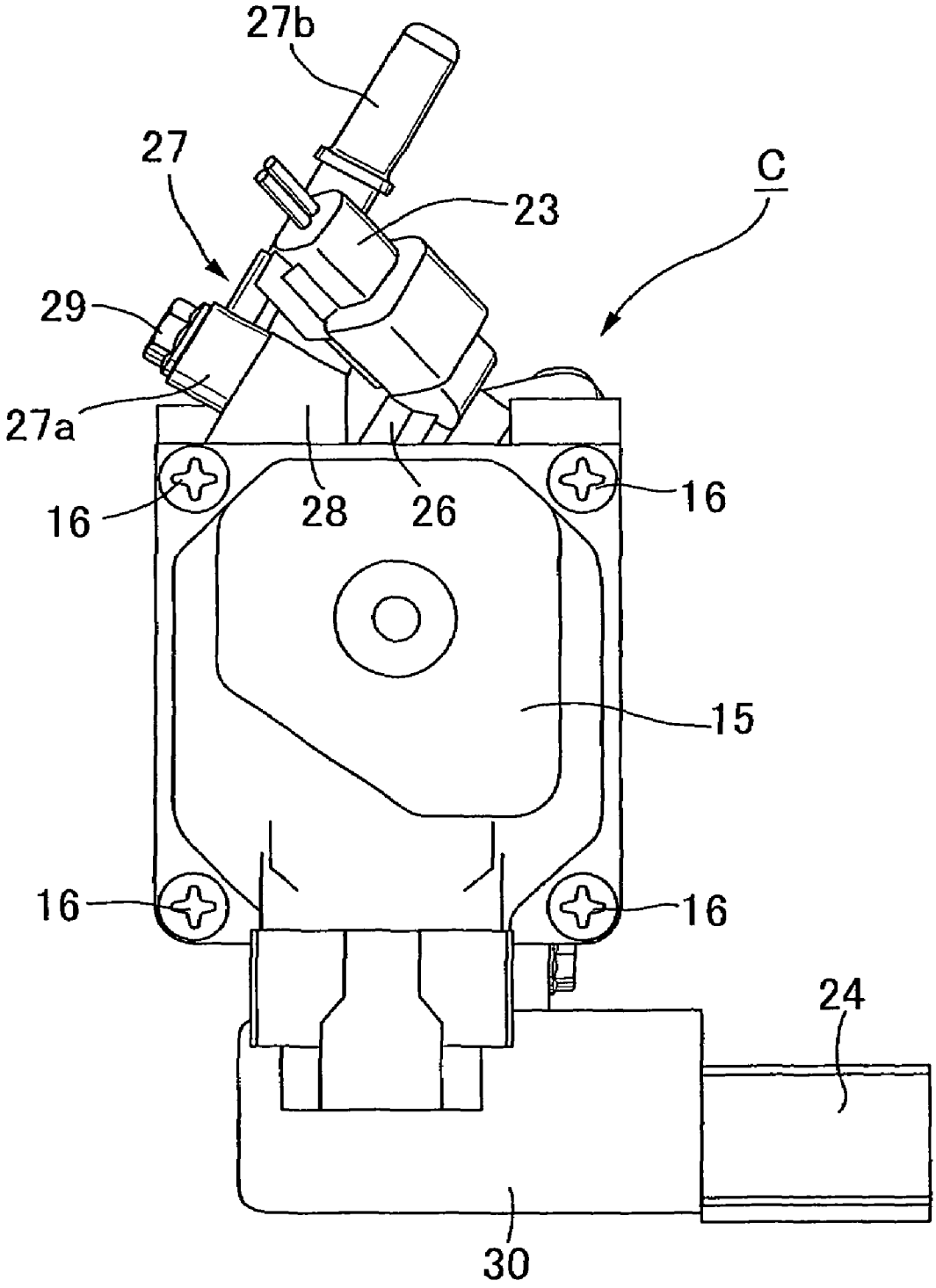
FIG. 6 is a view seen from an arrow 6 in FIG. 4.
Figure 7:
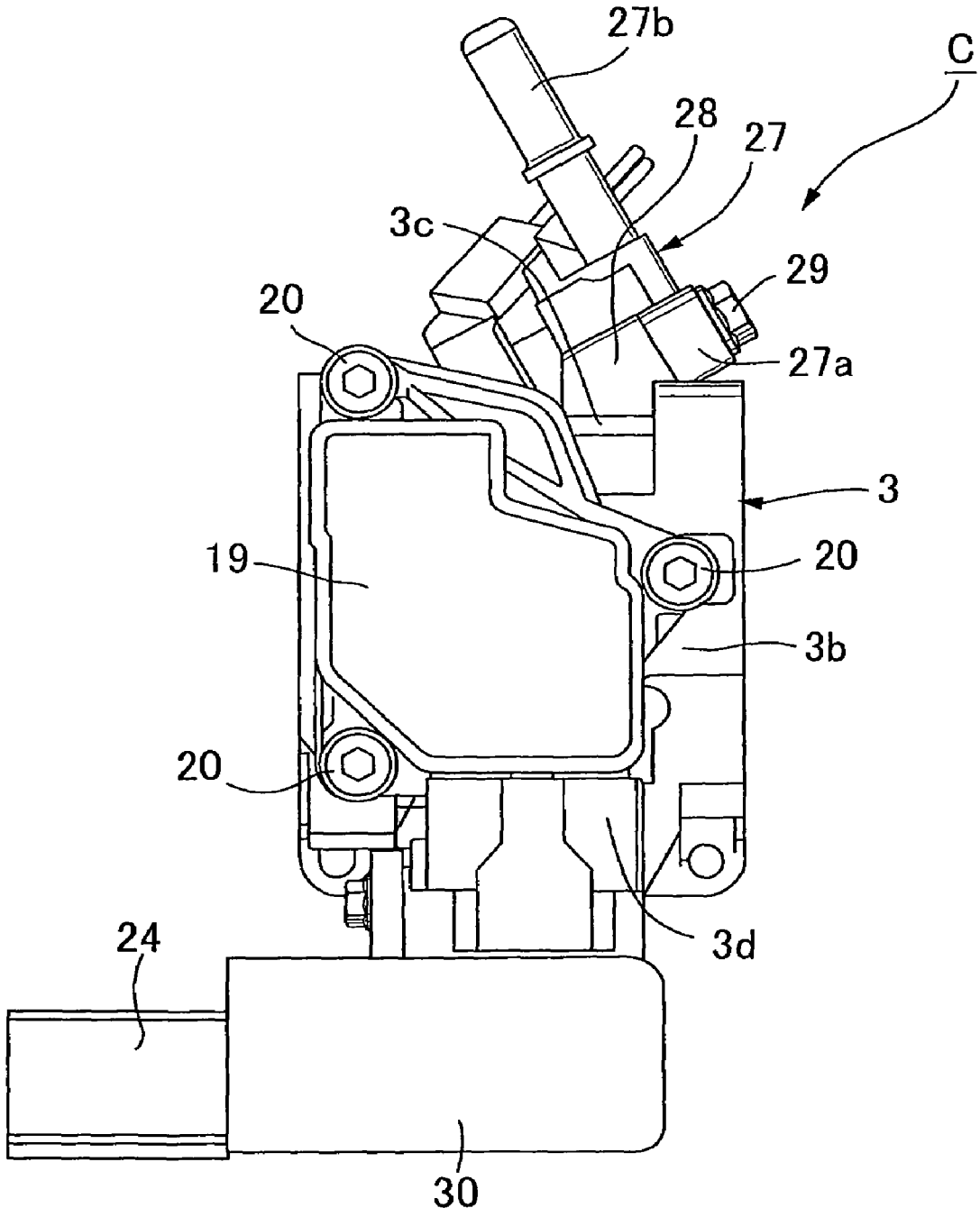
FIG. 7 is a view seen from an arrow 7 in FIG. 4.
Figure 8:
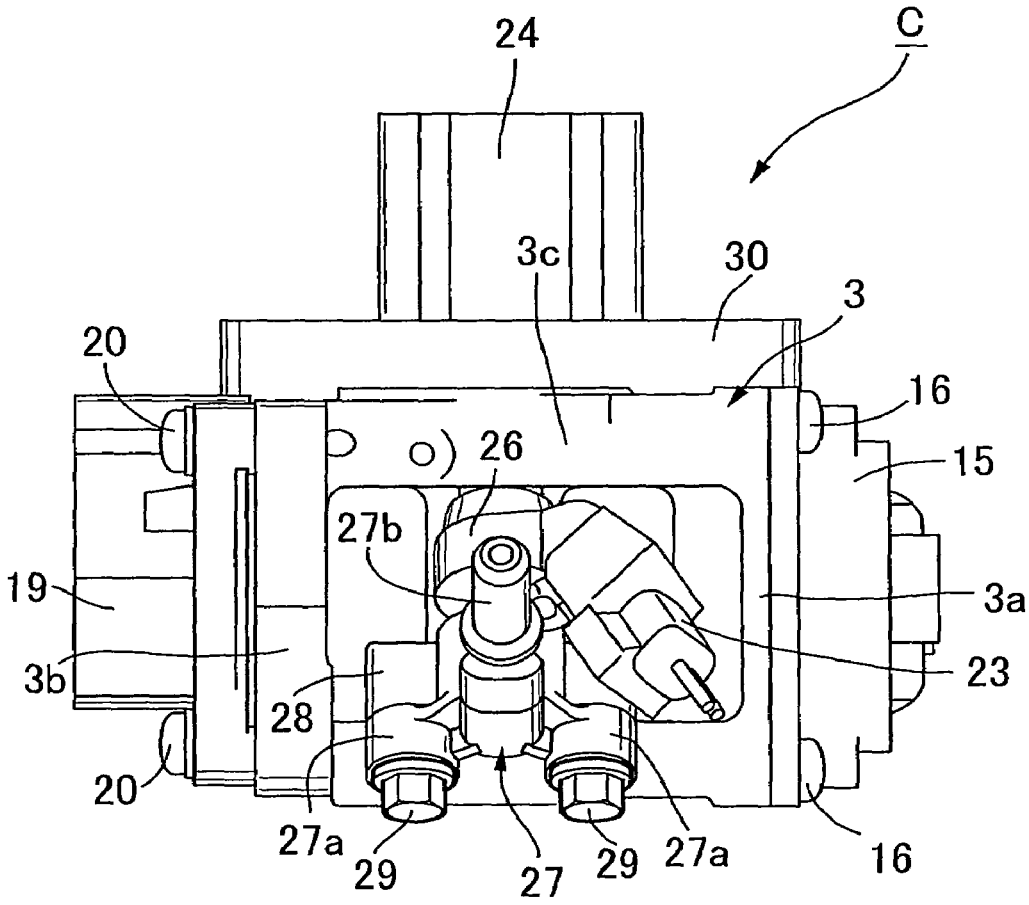
FIG. 8 is a view seen from an arrow 8 in FIG. 4.
Figure 9:
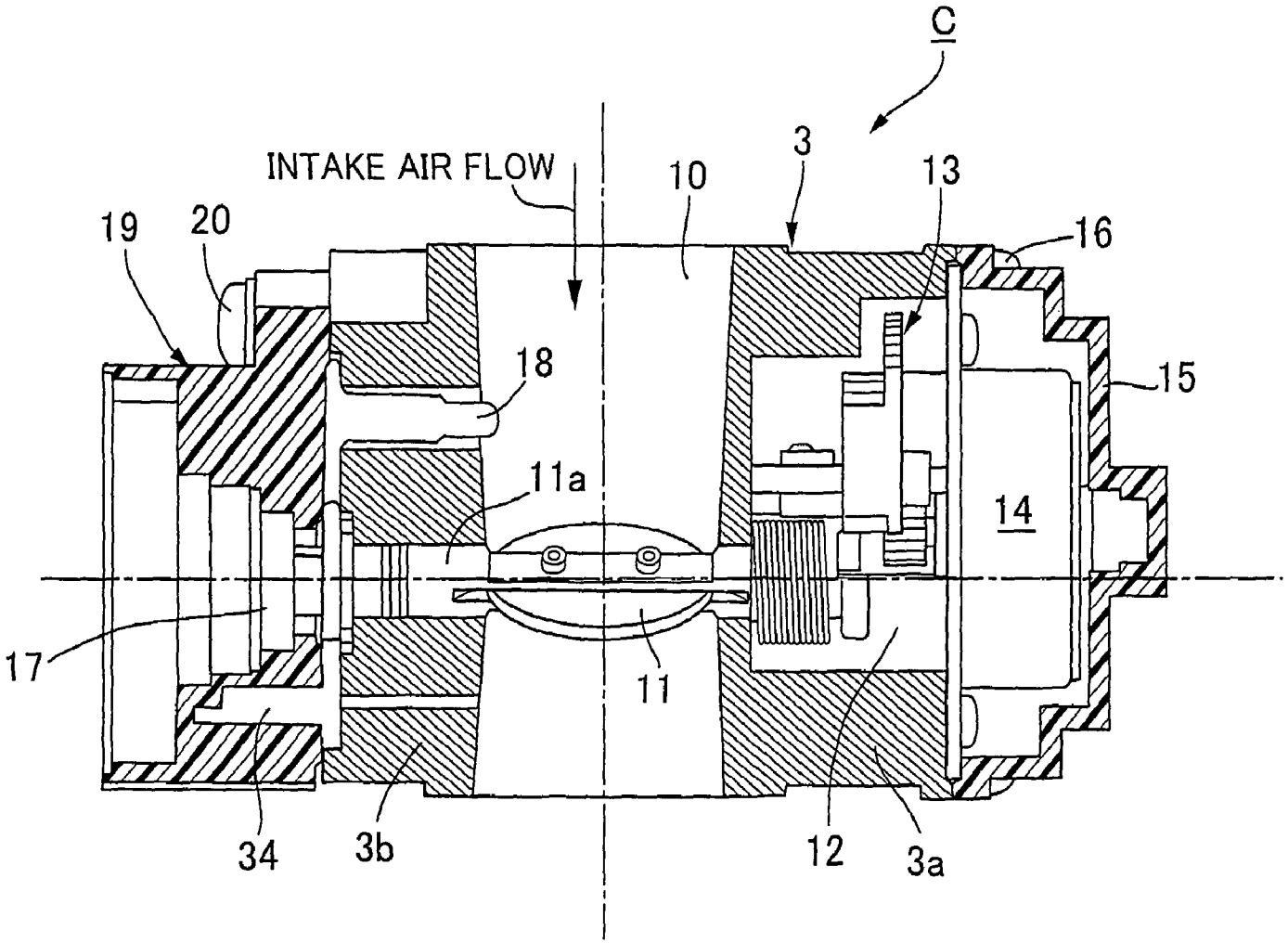
FIG. 9 is a cross-sectional view taken along a line 9-9 in FIG. 4.
Figure 10:
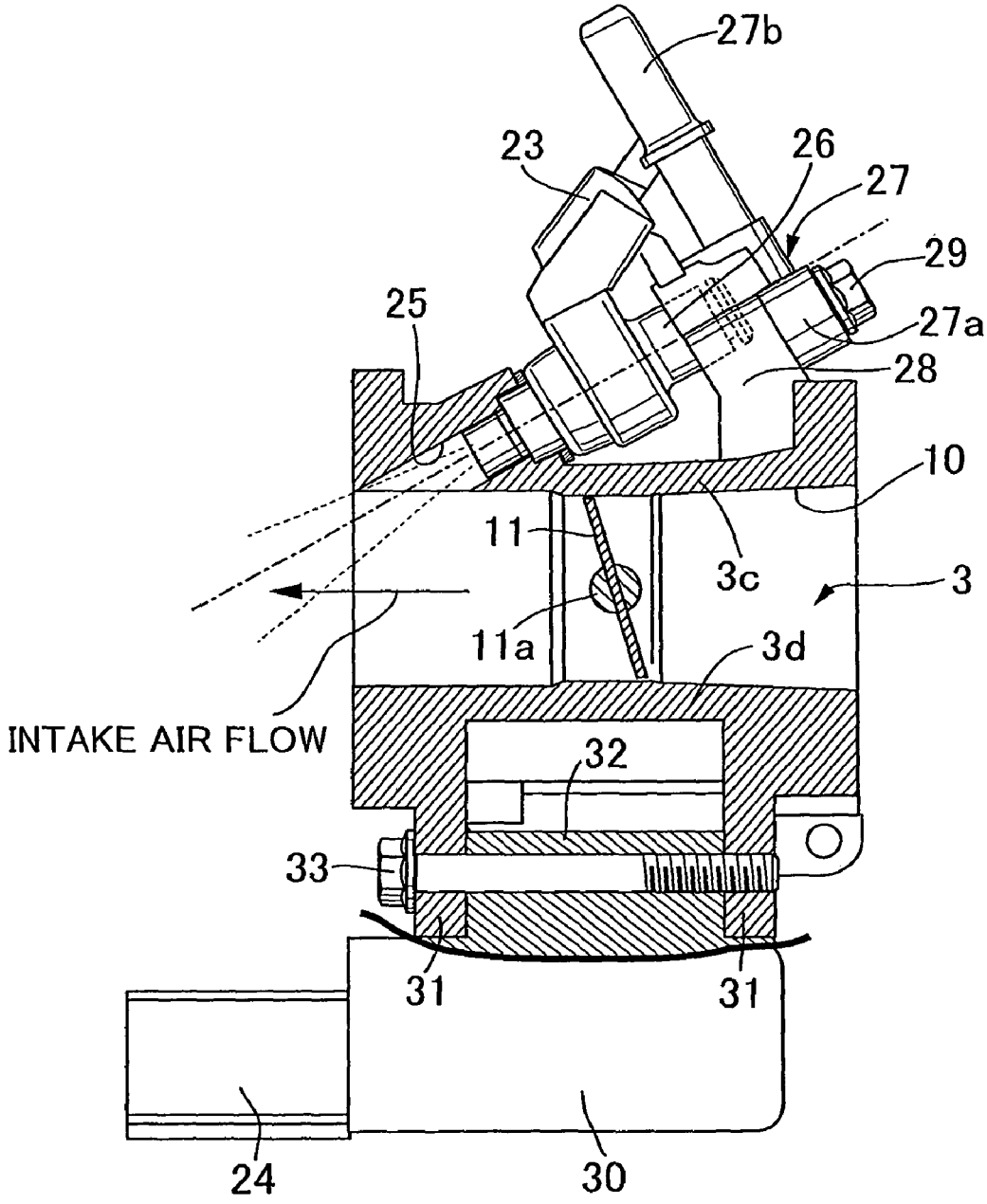
FIG. 10 is a cross-sectional view taken along a line 10-10 in FIG. 4.

Meanwhile, as shown in FIGS. 3 to 7, a pair of support walls 31 are formed in a fourth side wall 3*d* of the throttle body 3, which integrally connects lower end portions of the first and second side walls 3*a*, 3*b* to each other. The support walls 31 protrude downward from the fourth side wall 3*d*. An attachment 32 protruding from the upper surface of the electronic control unit 30 is fixed to these support walls 31 with bolts 33. In this way, the electronic control unit 30 is attached to the fourth side wall 3*d*. A fourth coupler 24 for electrical connection is formed at one side of the electronic control unit 30. As shown in FIG. 5, the fourth coupler 24 is connected to the first, second and third couplers 21 to 23 via first, second and third conducting wires 35 to 37, respectively. Furthermore, the electronic control unit 30 is connected to fourth to sixth conducting wires 38 to 40 that respectively communicate with a power supply 41, an engine-revolution-number setter 42, and an engine-revolution-number sensor 43 of an engine E.

In this manner, on the basis of a preset number of revolutions inputted from the engine-revolution-number setter 42 and various detection signals inputted from the sensor unit 19 while the engine E is in operation, the electronic control unit 30 operates the motor 14 to control the opening degree of the throttle valve 11 and controls the fuel injection amount from the fuel injection valve 26 so that the number of revolutions of the engine E can be stabilized to the preset number of revolutions. Particularly, the sensor unit 19 detects the intake-air temperature and the boost pressure in the intake path 10 besides the opening degree of the throttle valve 11. Then, the sensor unit 19 inputs the detection signals into the electronic control unit 30. Thus, the electronic control unit quickly corrects the opening degree of the throttle valve 11 and the fuel injection amount from the fuel injection valve 26 in accordance with the changes in the intake-air temperature and engine load, thereby allowing the variation in the number of revolutions of the engine to be reduced.

As has been described, the four elements, namely, the motor 14, the sensor unit 19, the fuel injection valve 26 and the electronic control unit 30, which are essential in intake control for the fuel injection general-purpose engine E, are attached to the intake control system C for a general-purpose engine of the present invention, while all of the first to fourth side walls 3*a* to 3*d* of the throttle body 3 surrounding the intake path 10 are effectively utilized. Thus, the intake control system C can be made compact. Furthermore, since the four elements 14, 19, 26, 30 are directly attached to the throttle body 3, the first to third conducting wires 35 to 37 that electrically connect the electronic control unit 30 to the motor 14, the sensor unit 19 and the fuel injection valve 26, respectively, are significantly shortened. Thereby, even when the general-purpose engine E is in operation under harsh conditions, a trouble on the wire can be prevented.

As has been described, the four elements, namely, the motor 14, the sensor unit 19, the fuel injection valve 26 and the electronic control unit 30, which are essential in intake control for the fuel injection general-purpose engine E, are attached to the intake control system C for a general-purpose engine of the present invention, while all of the first to fourth side walls 3*a* to 3*d* of the throttle bolt 3 surrounding the intake path 10 are effectively utilized. Thus, the intake control system C can be made compact. Furthermore, since the four elements 14, 19, 26, 30 are directly attached to the throttle body 3, the first to third conducting wires 35 to 37 that electrically connect the electronic control unit 30 to the motor

14, the sensor unit 19 and the fuel injection valve 26, respectively, are significantly shortened. Thereby, even when the general-purpose engine E is in operation under harsh conditions, a trouble on the wire can be prevented.

The present invention is not limited to the above-mentioned embodiment and may be modified in a variety of ways as long as the modifications do not depart from its gist. The intake control system of the present invention is also applicable to, for example, a horizontal general-purpose engine in which a crankshaft is disposed in a horizontal direction, and a vertical general-purpose engine in which a crankshaft is disposed in a vertical direction.

The invention claimed is:

1. An intake control system for a general-purpose engine, comprising:

a throttle body which includes an intake path, and which supports opposite end portions of a valve shaft of a throttle valve for opening and closing the intake path;

a motor which is attached to a first side wall of the throttle body, and which drives the throttle valve to be opened and closed, the first side wall supporting one end portion of the valve shaft;

a sensor unit which is attached to a second side wall of the throttle body, and which detects an opening degree of the throttle valve, the second side wall supporting the other end portion of the valve shaft;

a fuel injection valve which is attached to a third side wall of the throttle body, and through which a fuel is injected into the intake path at a position downstream of the throttle valve, the third side wall integrally connecting one end portions of the first and second side walls to each other; and an electronic control unit which is attached to a fourth side wall of the throttle body, and which controls operations of the motor and the fuel injection valve in accordance with an inputted preset number of revolutions of the engine and a detection signal from the sensor unit, the fourth side wall integrally connecting the other end portions of the first and second side walls to each other, wherein the electronic control unit is connected to the motor, the fuel injection valve and the sensor unit with first, second and third conducting wires, respectively.

2. The intake control system for a general-purpose engine according to claim 1, wherein the sensor unit detects an intake-air temperature and a boost pressure in the intake path besides the opening degree of the throttle valve, and inputs these detection signals into the electronic control unit.

* * * * *